US005911411A

United States Patent [19]

Krause et al.

[11] Patent Number: 5,911,411

[45] Date of Patent: Jun. 15, 1999

[54] COMBINATION STRAINER AND STAY AND THRUST MEMBER

[76] Inventors: Trevor Krause, 191 Rippon Road, Hamilton,Victoria, Australia, 3300; Anthony John Baillieu, Mt. Elephant, Derrinallum, Victoria, Australia, 3325

[21] Appl. No.: 08/919,037

[22] Filed: Aug. 27, 1997

Related U.S. Application Data

[63] Continuation-in-part of application No. 08/686,343, Jul. 25, 1996, abandoned.

[30] Foreign Application Priority Data

Feb. 21, 1996 [AU] Australia ..... 96 45655

[51] Int. Cl.[6] ..... E04H 17/00

[52] U.S. Cl. ..... 256/35; 256/31; 256/64

[58] Field of Search ..... 256/32, 35, 36, 256/59, 62, 63, 64, 19, 24, 1, 30, 31

[56] References Cited

U.S. PATENT DOCUMENTS

| | | |
|---|---|---|
| 301,683 | 7/1884 | Combs . |
| 314,785 | 3/1885 | Bissells . |
| 471,160 | 3/1892 | Winslow . |
| 1,018,894 | 2/1912 | Fournie . |
| 4,909,483 | 3/1990 | van Herpen . |

FOREIGN PATENT DOCUMENTS

| | | |
|---|---|---|
| 517705 | 3/1980 | Australia . |
| 8708282 | 8/1982 | Australia . |
| 3012681 | 10/1981 | Germany . |
| 1136611 | 12/1968 | United Kingdom . |

*Primary Examiner*—Harry C. Kim
*Attorney, Agent, or Firm*—Richard M. Goldberg

[57] ABSTRACT

A strainer/stay combination for use in fencing, includes a strainer having one end to be inserted into the ground; a unitary, one-piece prop member connected to the strainer, the prop member having first and second opposite ends, with the first end connectable with the strainer; a thrust member locatable on or in the ground, the thrust member including an upper surface and a channel which is open at the upper surface, the channel having a non-linear portion, and the channel receiving the second end of the prop member at an acute angle to the ground; an adjustable elongated tensioning member for connecting the thrust member to the strainer, the tensioning member having a first end with a non-linear portion which is received, located and held in the non-linear portion of the channel and a hook at the first end such that the second end of the prop member engages with the hook to hold the first end of the tensioning member in the channel, and a second threaded end which penetrates the strainer; and a nut engaging the second threaded end of the tensioning member for adjustably moving the tensioning member in an axial direction thereof; wherein, in use, the prop member once received is located at an acute angle with respect to the tensioning member and the prop member is held in compression against the strainer, thus preventing lateral movement of the strainer under the influence of lateral strain.

17 Claims, 5 Drawing Sheets

COMBINATION STRAINER AND STAY AND THRUST MEMBER

The present application is a Continuation-In-Part of U.S. patent application Ser. No. 08/686,343, filed Jul. 25, 1996, by the same applicant herein, and entitled COMBINATION STRAINER AND STAY AND THRUST MEMBER, now abandoned.

BACKGROUND OF THE INVENTION

This invention relates to a combination strainer and stay and thrust member for use in fencing.

It is known to use posts at the end of a run of fencing and in particular where the run of fencing terminates at a gate. These posts are under considerable strain once the fencing wire is tensioned and it is not uncommon upon tensioning of the fencing wire for the posts to move resulting in the fencing wire becoming slack and in some cases the fence falling over. Traditionally posts are made from heavy timber and buried well into the ground in an endeavor to overcome and prevent the above problem.

A further attempt has previously been made to overcome this problem by using a prop which is placed at angle from the post to the ground in an effort to resist the post moving once the fencing wire is tensioned.

However, the fastening of such props and their attachments to the post and, also to the ground, is labor intensive and not always successful.

Australian Patent Application No 517705 Manning relates to a stay for a post comprising a rigid supporting member, running at an angle from the post to the ground and an adjusting member running from the post to the remote end of the supporting member. Preferably the remote end of the supporting member is provided with a horizontally located plate portion which engages the ground. The plate portion also interacts with the adjusting member. Manning's adjusting member uses an internally threaded sleeve member which engages first and second bar members to provide adjustability.

In Australian Specification No 87082/82 O'Brien and Keeping, a bracing arrangement for a post is disclosed which comprises a strut member which is pivotally connected at one end of an upper portion of the post and is supported by the ground at its other end. The strut member comprises two strut elements which may be moved axially with respect to each other by means of a jacking device. In one embodiment a lower member is provided fashioned with an end hook to engage the distal end of the strut member holding it in tension with the lower portion of the post. While such stay and bracing arrangements are effective in certain terrain and conditions, set up and use of these arrangements are complex and labor intensive and farmers are looking for more and more ways for a more efficient arrangement resulting in production of labor and set up costs.

It is therefore desirable to provide an improved combination strainer and stay and thrust member (hereinafter referred to as "strainer/stay combination") which is quick and easy to erect.

It is also desirable to provide an improved strainer/stay combination which is pre-fabricated for ease of erection.

It is also desirable to provide an improved strainer/stay combination wherein the thrust member is shaped to position the stay with respect to an adjustable tensioning means.

It is also desirable to provide an improved strainer/stay combination which can be attached easily and quickly to a post.

SUMMARY OF THE INVENTION

It is therefore an object of the present invention to provide a strainer/stay combination which obviates the problem of posts moving under stress when tensioning fences.

According to one aspect of the present invention there is provided a strainer/stay combination for use in fencing, the strainer/stay combination including:

- a strainer having means adapted to be inserted into the ground;
- a prop member which is connected to the strainer;
- a thrust member which is connected to the prop member and which is located on or in the ground; and
- an adjustable tensioning means for connecting the thrust member to the strainer, wherein the thrust member includes a means to receive, locate and hold the tensioning means and the prop member, where said prop member once received is located at an acute angle with the tensioning means and wherein the prop member is held in tension against the strainer preventing lateral movement of the strainer under the influence of lateral strain.

The strainer/stay combination is made of a suitable material, for example a metal such as galvanised steel, or, in an alternative form of the invention the strainer/stay combination is partly of metal and partly of wood. For example, the strainer (hereinafter referred to as a "post") may be of some suitable resistant timber.

The prop member is conveniently, a pipe or rod, for example, a pipe of galvanised steel. In the preferred form of the invention the prop member is positioned so as to form an acute angle with the tensioning means, where such angle is preferably between 20 and 25 degrees. As described above the prop member is of any suitable material, however if a relatively thin material is used, one end may be strengthened by an insert such as an internal, circumferential insert and the other end may be closed and be provided with a longitudinal, circumferential rod adapted to engage the strainer.

The thrust member is weather resistant, and in particular water resistant. In a preferred form of the invention the said thrust member is made from a plastics material, for example, a recycled plastics material comprising an ultra violet stabliser. In an alternative form of the invention the thrust member is a metal such as galvanised steel.

In a further embodiment of the invention the thrust member is fashioned to have a broad base and adapted to have a means to connect the tensioning means and the prop means to the thrust member. The upper surface of the thrust member incorporates an elongated hollow adapted to enable the tensioning means to interlock with the prop member. The elongated hollow comprises a channel to guide the tensioning means, slightly downwardly, towards the mid portion of the thrust member so that the tensioning means engages one end of the prop.

In the preferred form of the invention the tensioning means is an elongated member, which is a pipe or rod, which is threaded at one or both ends and which is adapted so that one end of said tensioning means penetrates the post whilst the other end of said tensioning means engages the thrust means.

In a further form of the invention, the tensioning means has a hook at one end which engages the prop member.

In a further still form of the invention the tensioning means may also be shaped for locating engagement with the thrust means.

The tensioning means as described in the above embodiments, may employ the use of a threaded nut or nuts to achieve tensioning.

It is preferred that the location of the tensioning means is governed by environmental factors. For example where the ground is relatively dry, the tensioning means may be located close to ground level. Alternatively, the tensioning means is spaced from the ground and generally parallel to the ground where the ground is relatively damp or wet in order to reduce the possibility of rust.

In the preferred form of the invention the thrust member comprises an elongated hollow which provides an elongated guide for the tensioning means and also an angled guide for the prop member. Therefore, the prop member and the tensioning means may be brought together resulting in a relatively sharp corner obtained and an acute included angle formed between the prop member and the tensioning means. The stability of the strainer/stay combination is substantially increased by the formation of such a triangle.

For practical purposes, the strainer/stay combination according to the invention is suitable for posts of, for example, 3.7 meters (approximately 12 feet) for emu, ostrich and deer; 3.1 meters (approximately 10 feet) for vineyards; and 2.1 meters (approximately 8 feet) for gravel areas. The depth of penetration into the ground of the strainer/stay combination is determined by the type of ground where the invention is to be used, that is, whether the environmental factors are dry and or wet and flood prone.

BRIEF DESCRIPTION OF THE DRAWINGS

One embodiment of the present invention will now be described with reference to the drawings in which.

DETAILED DESCRIPTION

In order that the invention may be more readily understood we shall hereinunder describe the features of the invention.

Figure 1:
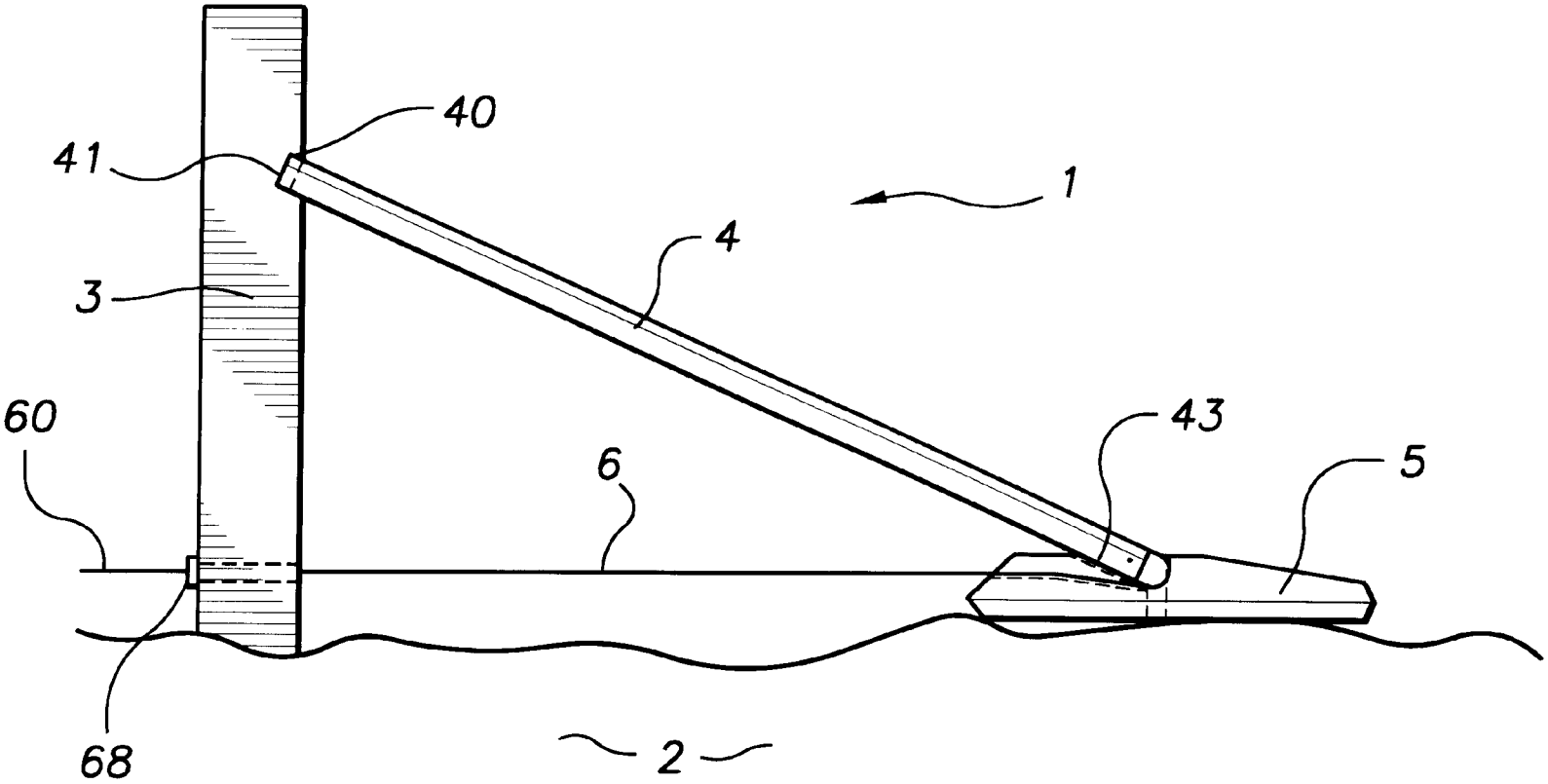
FIG. 1 is a side view of a first strainer/stay combination.

Referring to the drawings, FIG. 1 illustrates the strainer/stay combination 1 in operation. Into the ground 2 is inserted a post 3 which is adapted by means of a hole to receive prop member 4. Located on the connecting portion of the prop member 4 is an end cap connector 40 which is provided with a longitudinal projecting rod 41 near the circumference of the connector for facilitating connection of the prop member 4 via the corresponding hole (not shown) to post 3.

The other end of prop member 4 is connected to the thrust member 5 which is positioned on the ground 2.

Located on the lower portion of the post 3 is a channel (not shown) which has a means adapted to receive a first end 60 of the tensioning means 6 therethrough. Located at the other end of the tensioning means 6 is a hook 61 which interlocks with prop member 4.

Figure 2:
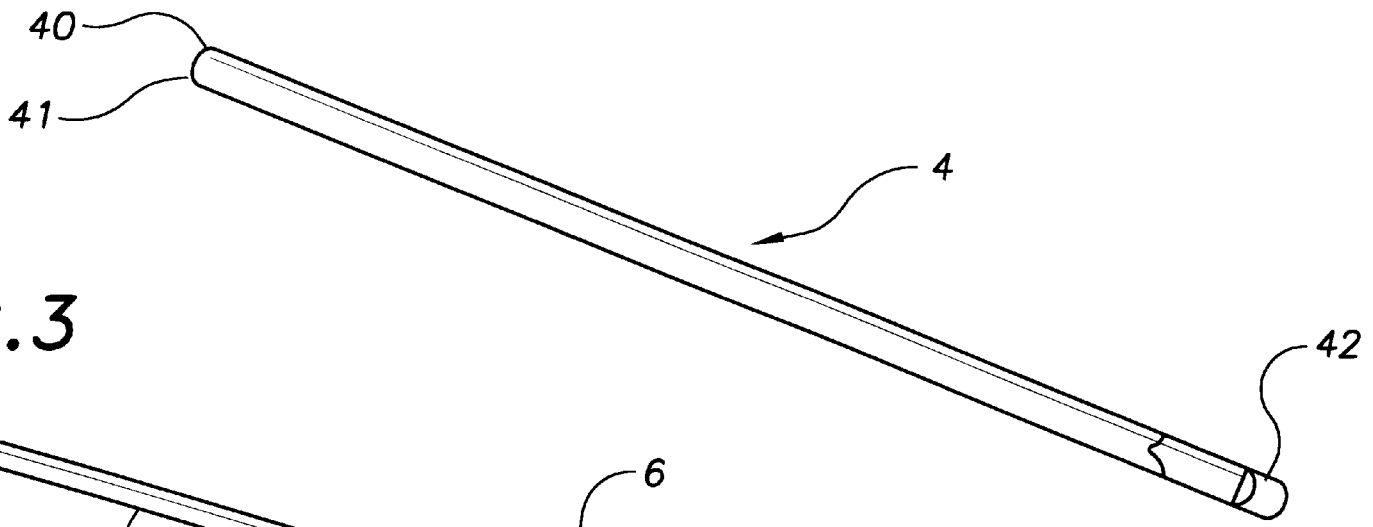
FIG. 2 is a side view of a prop member.

Referring to FIG. 2, the prop member 4 has located at one end, an end cap connector 40 which as described above is provided with a circumferential longitudinal projecting rod 41. Located at the other end of prop member 4 is a circumferential strengthening ring 42 which is arranged inside an open mouth at the other end of the prop member 4.

Figure 3:
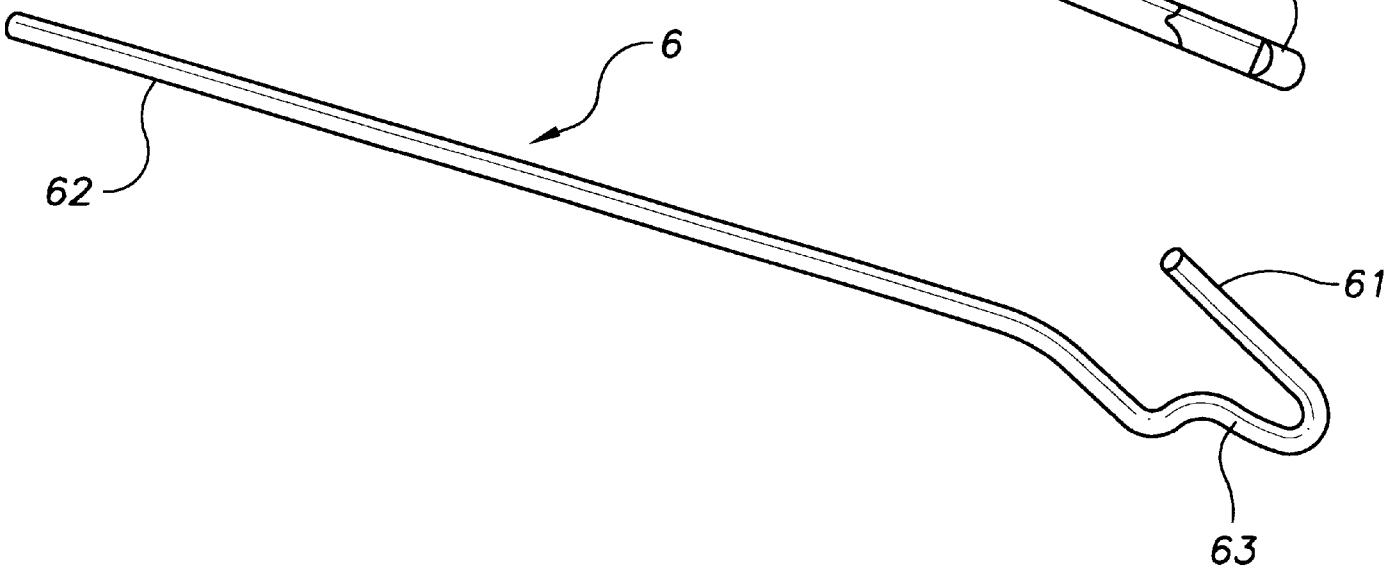
FIG. 3 is a side view of a tensioning means.

Referring to FIG. 3, the tensioning means 6 has located at one end a threaded portion 62 adapted to pass through the channel located in the post 3. A nut 68 is provided thereon to achieve tensioning of the tensioning member. At the other end of the tensioning means 6 is a kink 63 and a hook 61 where said kink 63 is internally directed within the space partially bounded by hook 61.

Figure 4:
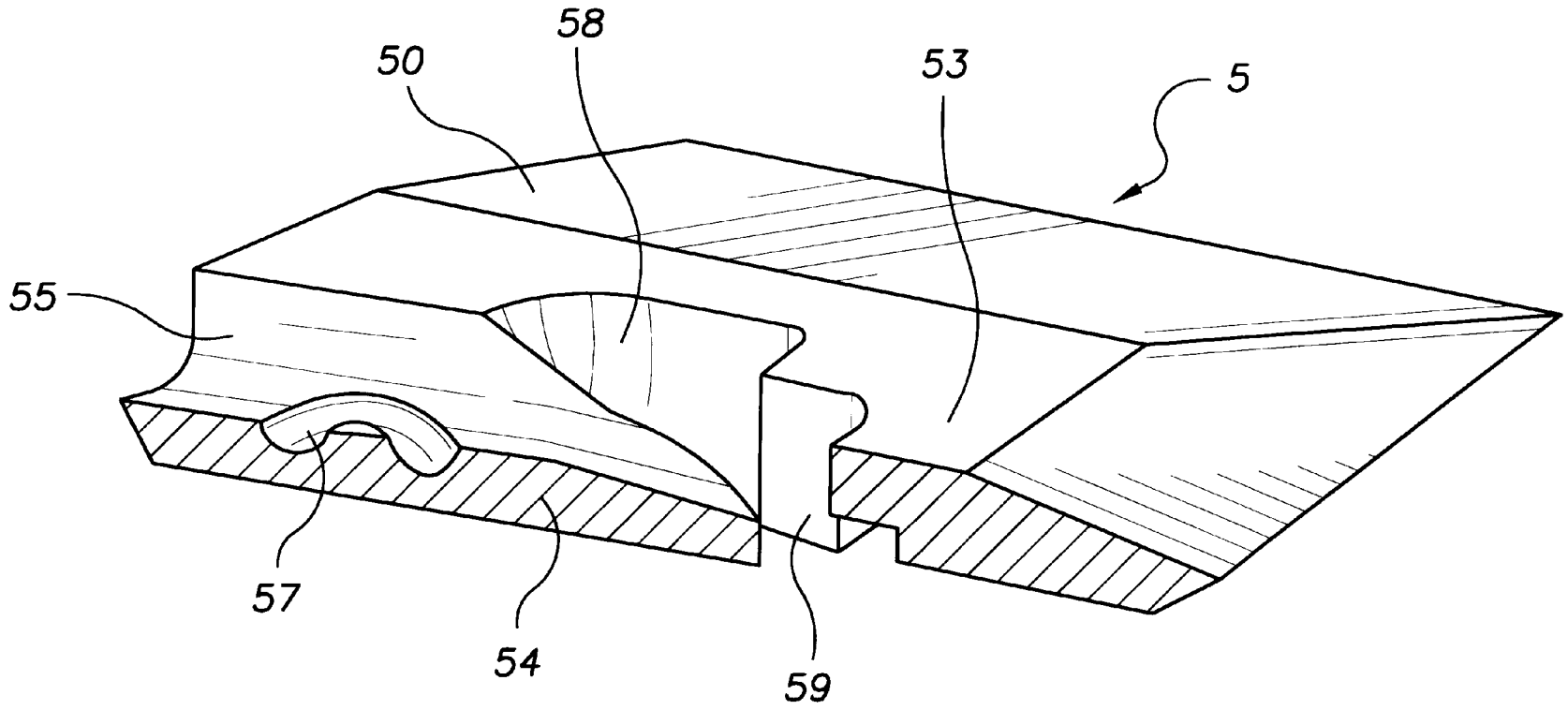
FIG. 4 is a cross sectional view from above a thrust member.
Figure 5:
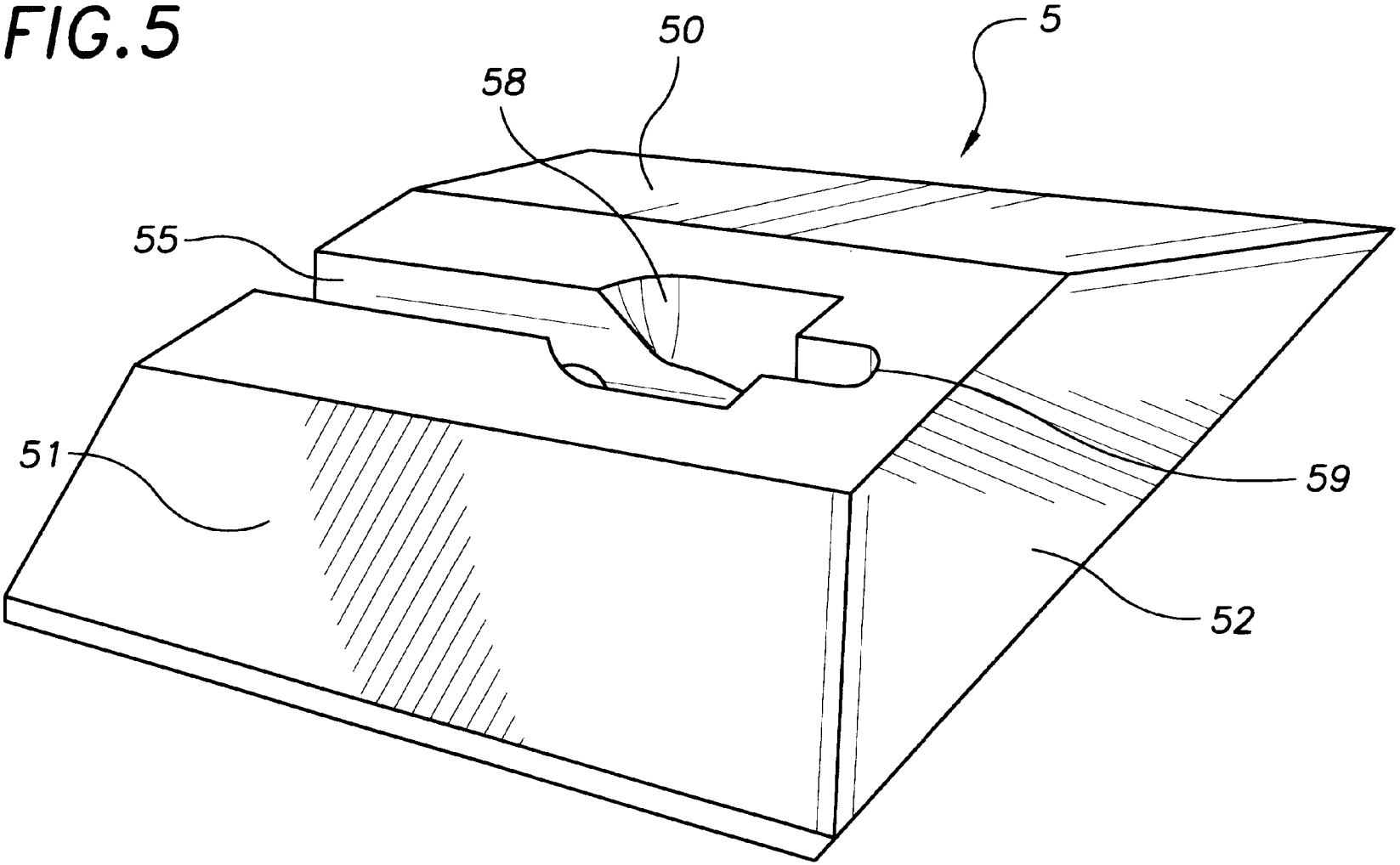
FIG. 5 is an isometric view of the thrust member of FIG. 4.
Figure 6:
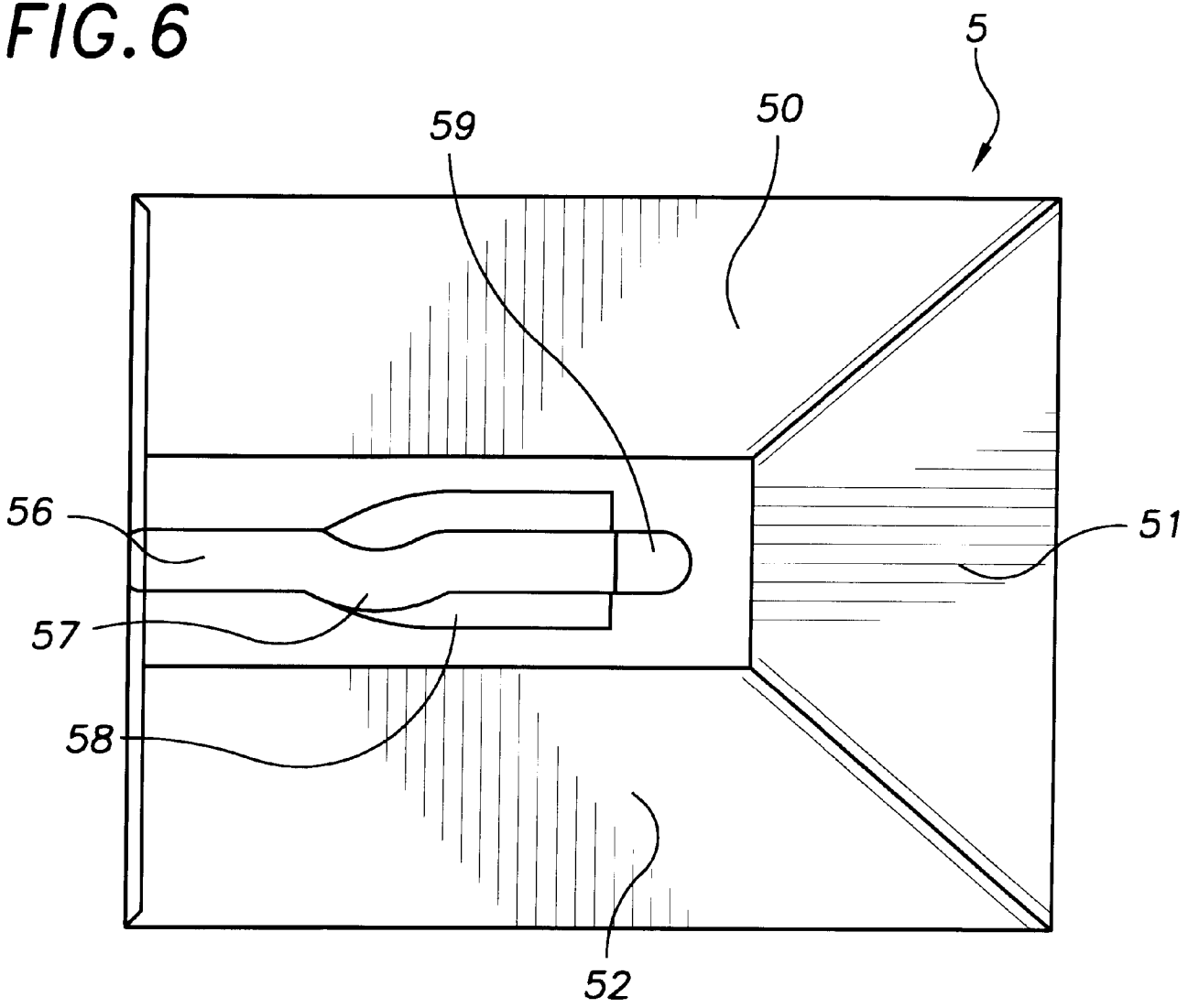
FIG. 6 is a plan view from above of the thrust member of FIGS. 4 and 5.

Referring to FIGS. 4, 5 and 6 the thrust member 5 is provided with a substantially square plan and has sloping edges 50, 51 and 52. The thrust member 5 has an upper surface 53 and a lower surface 54. Leading into the mid portion of the thrust member 5 is a wide upper groove 55 which overlies a narrow lower groove 56. Narrow lower groove 56 is provided with a meander 57 adapted to cooperate with kink 63 in tensioning means 6. These grooves lead to a wide curved hollow 58, terminating in a vertical hole 59 which acts as a drain hole.

The lower groove 56 and the meander 57 position the adjustable tensioning means 6 in order to eliminate movement thereof and the upper groove 55 and the hollow 58 position the prop member 4, the hook 61 on the end of the tensioning means 6 being held by the prop member 4.

Thus prop member 4 and tensioning means 6 when assembled in the strainer/stay combination 1 come together in what is in essence a point, these integers being located and held together by thrust member 5.

Meander 57 serves to prevent longitudinal movement of tensioning means 6.

In a still further embodiment of the invention it is envisaged that the prop member 4 connects to the thrust member 5 whilst the tensioning means 6 also connects to the thrust member 5 where said connection to thrust member 5 may be separate connections.

The claims defining the invention are as follows:

1. A strainer/stay combination for use in fencing comprising:

a strainer having one end adapted to be inserted into the ground;

a unitary, one-piece prop member connected to the strainer;

and an adjustable tensioning member for connecting a thrust member to the strainer such that the thrust member is connected to the prop member and locatable on or in the ground, the thrust member including an arrangement to receive, locate and hold the tensioning member and the prop member, wherein the thrust member includes a broad base and an upper surface, which upper surface includes an elongated hollow having a channel to receive and guide the tensioning member, slightly downwardly, towards a mid portion of the thrust member, where the tensioning member engages one end of the prop member, wherein, in use, the prop member once received is located at an acute angle with respect to the tensioning member and the prop member is held in compression against the strainer, thus preventing lateral movement of the strainer under the influence of lateral strain.

2. A strainer/stay combination as claimed in claim 1 wherein the acute angle is between 20 and 25 degrees.

3. A strainer/stay combination as claimed in claim 1 wherein the prop member is provided with one end strengthened by a strengthening member including an internal, circumferential insert and where the other end of the said prop member is closed and provided with a longitudinal, circumferential rod adapted to engage the strainer.

4. A strainer/stay combination as claimed in claim 1 wherein the thrust member is water and weather resistant.

5. A strainer/stay combination as claimed in claim 4 wherein the thrust member is a plastics material comprising an ultra violet stabliser.

6. A strainer/stay combination as claimed in claim 1 wherein the thrust member is a metal.

7. A strainer/stay combination as claimed in claim 1 wherein the tensioning member is an elongated member.

8. A strainer/stay combination as claimed in claim 7 wherein the tensioning member is threaded at at least one end.

9. A strainer/stay combination as claimed in claim 8 wherein one end of the tensioning member penetrates the strainer and the other end of said tensioning member engages the thrust member.

10. A strainer/stay combination as claimed in claim 9 wherein the tensioning member includes at least one threaded nut used to achieve tensioning of the tensioning member.

11. A strainer/stay combination as claimed in claim 7 wherein the tensioning member includes a hook at one end which engages the prop member.

12. A strainer/stay combination as claimed in claim 7 wherein the tensioning member is shaped for locating engagement with the thrust member.

13. A strainer/stay combination for use in fencing, comprising:

a strainer having one end adapted to be inserted into the ground;

a unitary, one-piece prop member connected to the strainer, the prop member having first and second opposite ends, with the first end connectable with said strainer;

a thrust member locatable on or in the ground, the thrust member including an upper surface and a channel which is open at the upper surface, the channel having a non-linear portion, and the channel receiving the second end of the prop member at an acute angle to the ground;

an adjustable elongated tensioning member for connecting the thrust member to the strainer, the tensioning member having a first end with a non-linear portion which is received, located and held in the non-linear portion of the channel, and a second end which penetrates the strainer; and a device engaging the second end of the tensioning member for adjustably moving the tensioning member in an axial direction thereof;

wherein, in use, the prop member once received is located at an acute angle with respect to the tensioning member and the prop member is held in compression against the strainer, thus preventing lateral movement of the strainer under the influence of lateral strain.

14. A strainer/stay combination as claimed in claim 13 wherein the tensioning member is threaded at said second end thereof, and the device engaging the second end of the tensioning member includes a threaded nut which is threadedly received on the second end of the tensioning member to achieve tensioning of the tensioning member.

15. A strainer/stay combination for use in fencing, comprising:

a strainer having one end adapted to be inserted into the ground;

a unitary, one-piece prop member connected to the strainer, the prop member having first and second opposite ends, with the first end connectable with said strainer;

a thrust member locatable on or in the ground, the thrust member including an upper surface and a channel which is open at the upper surface, and the channel receiving the second end of the prop member at an acute angle to the ground;

an adjustable elongated tensioning member for connecting the thrust member to the strainer, the tensioning member having a first end with a hook which is received, located and held in the channel such that the second end of the prop member engages with the hook in the channel to hold the first end of the tensioning member in the channel, and a second end which penetrates the strainer; and a device engaging the second end of the tensioning member for adjustably moving the tensioning member in an axial direction thereof;

wherein, in use, the prop member once received is located at an acute angle with respect to the tensioning member and the prop member is held in compression against the strainer, thus preventing lateral movement of the strainer under the influence of lateral strain.

16. A strainer/stay combination as claimed in claim 15 wherein the channel includes a non-linear portion, and the first end of the tensioning member includes a non-linear portion which is received, located and held in the non-linear portion of the channel.

17. A strainer/stay combination as claimed in claim 15 wherein the tensioning member is threaded at said second end thereof, and the device engaging the second end of the tensioning member includes a threaded nut which is threadedly received on the second end of the tensioning member to achieve tensioning of the tensioning member.

* * * * *